US007285712B2

(12) United States Patent
Hsieh et al.

(10) Patent No.: US 7,285,712 B2
(45) Date of Patent: Oct. 23, 2007

(54) METHOD OF DYNAMICALLY DETERMINING A MAXIMUM POLYPHONY NUMBER ACCORDING TO OPERATION MODE AND SMOOTHLY CHANGING POLYPHONY NUMBER WHEN SWITCHING OPERATION MODES

(75) Inventors: Yu-Cheng Hsieh, Renwu Township, Kaohsiung County (TW); Ti-Wen Yuan, Dali (TW)

(73) Assignee: MediaTek Incorporation, Hsin-Chu (TW)

( * ) Notice: Subject to any disclaimer, the term of this patent is extended or adjusted under 35 U.S.C. 154(b) by 225 days.

(21) Appl. No.: 11/109,421

(22) Filed: Apr. 19, 2005

(65) Prior Publication Data

US 2005/0262990 A1 Dec. 1, 2005

(30) Foreign Application Priority Data

May 25, 2004 (TW) ..... 93114835 A
May 25, 2004 (TW) ..... 93114836 A

(51) Int. Cl.
*G10H 1/00* (2006.01)
*G10H 7/00* (2006.01)

(52) U.S. Cl. ..... 84/615; 84/618; 84/622; 84/625; 84/653; 84/656

(58) Field of Classification Search ..... None
See application file for complete search history.

(56) References Cited

U.S. PATENT DOCUMENTS

| | | | | |
|---|---|---|---|---|
| 5,107,747 | A * | 4/1992 | Saito | 84/655 |
| 5,200,564 | A * | 4/1993 | Usami et al. | 84/602 |
| 5,221,803 | A * | 6/1993 | Izumisawa et al. | 84/653 |
| 5,354,948 | A * | 10/1994 | Toda | 84/624 |
| 5,808,221 | A | 9/1998 | Ashour et al. | 84/603 |
| 5,920,843 | A | 7/1999 | Fay | 704/503 |
| 5,925,842 | A * | 7/1999 | Saito | 84/604 |
| 6,008,446 | A | 12/1999 | Van Buskirk et al. | 84/603 |
| 6,459,030 | B1 | 10/2002 | Di Paolo et al. | 84/620 |
| 2002/0152877 | A1 * | 10/2002 | Kay | 84/609 |

* cited by examiner

*Primary Examiner*—Marlon Fletcher
(74) *Attorney, Agent, or Firm*—Thomas, Kayden, Horstemeyer & Risley

(57) ABSTRACT

A method of dynamically determining a maximum polyphony number is used in an electronic device, which has S tone generators. First, an operation mode of the electronic device is detected. Next, a residual computing power of the electronic device is obtained according to the operation mode. Then, a maximum polyphony number is determined according to a constant computing power, which is required to synthesize a polyphony, and the residual computing power. Next, the states of T tone generators of the S tone generators are set to be an ON state according to the maximum polyphony number, wherein T is a positive integer and is smaller than or equal to S.

35 Claims, 7 Drawing Sheets

| | |
|---|---|
| ON/PLAYING | 24a |
| ON/PLAYING | 24b |
| OFF | 24c |
| OFF | 24d |
| ON/PLAYING | 24e |
| ON/PLAYING | 24f |
| ON/PLAYING | 24g |
| OFF | 24h |
| OFF | 24i |
| ON/PLAYING | 24j |

FIG. 6A

| | |
|---|---|
| ON/PLAYING | 24a |
| ON/PLAYING | 24b |
| ON/STANDBY | 24c |
| ON/STANDBY | 24d |
| ON/PLAYING | 24e |
| ON/PLAYING | 24f |
| ON/PLAYING | 24g |
| OFF | 24h |
| OFF | 24i |
| ON/PLAYING | 24j |

FIG. 6B

| | |
|---|---|
| ON/PLAYING | 24a |
| ON/PLAYING | 24b |
| ON/PLAYING | 24c |
| ON/STANDBY | 24d |
| ON/PLAYING | 24e |
| ON/PLAYING | 24f |
| ON/PLAYING | 24g |
| OFF | 24h |
| OFF | 24i |
| ON/PLAYING | 24j |

FIG. 6C

| | |
|---|---|
| ON/PLAYING | 24a |
| ON/PLAYING | 24b |
| ON/PLAYING | 24c |
| ON/PLAYING | 24d |
| ON/PLAYING | 24e |
| ON/PLAYING | 24f |
| ON/PLAYING | 24g |
| OFF | 24h |
| OFF | 24i |
| ON/PLAYING | 24j |

FIG. 6D

| | |
|---|---|
| ON/PLAYING | 24a |
| ON/PLAYING | 24b |
| ON/PLAYING | 24c |
| ON/PLAYING | 24d |
| ON/PLAYING | 24e |
| ON/PLAYING | 24f |
| ON/PLAYING | 24g |
| OFF | 24h |
| OFF | 24i |
| ON/PLAYING | 24j |

FIG. 7A

| | |
|---|---|
| ON/PLAYING | 24a |
| ON/PLAYING | 24b |
| ON/STANDBY | 24c |
| ON/PLAYING | 24d |
| ON/PLAYING | 24e |
| ON/PLAYING | 24f |
| ON/PLAYING | 24g |
| OFF | 24h |
| OFF | 24i |
| ON/PLAYING | 24j |

FIG. 7B

| | |
|---|---|
| ON/PLAYING | 24a |
| ON/PLAYING | 24b |
| OFF | 24c |
| ON/STANDBY | 24d |
| ON/PLAYING | 24e |
| ON/PLAYING | 24f |
| ON/PLAYING | 24g |
| OFF | 24h |
| OFF | 24i |
| ON/PLAYING | 24j |

FIG. 7C

| | |
|---|---|
| ON/PLAYING | 24a |
| ON/PLAYING | 24b |
| OFF | 24c |
| OFF | 24d |
| ON/PLAYING | 24e |
| ON/PLAYING | 24f |
| ON/PLAYING | 24g |
| OFF | 24h |
| OFF | 24i |
| ON/PLAYING | 24j |

FIG. 7D

METHOD OF DYNAMICALLY DETERMINING A MAXIMUM POLYPHONY NUMBER ACCORDING TO OPERATION MODE AND SMOOTHLY CHANGING POLYPHONY NUMBER WHEN SWITCHING OPERATION MODES

This application claims the benefits of Taiwan applications Serial No. 93114835 and 93114836, both filed May 25, 2004, the subject matter of which is incorporated herein by reference.

BACKGROUND OF THE INVENTION

1. Field of the Invention

The invention relates in general to a method of changing a polyphony number, and more particularly to a method of dynamically determining a maximum polyphony number according to an operation mode of the electronic device, and smoothly changing a polyphony number according the switch of the operation modes of the electronic device.

2. Description of the Related Art

Electronic devices have become indispensable in the daily life of the modern human beings. With the electrical communication devices, such as mobile telephones and personal digital assistants (PDAs), conforming with the communication protocol specifications including the globe system for mobile communications (GSM), the circuit switch data (CSD) and the general packet radio service (GPRS), people can communicate with others at any place.

In addition, with the newly developed software music synthesizer technology, the electronic device can play music that has been upgraded from the monophonic ring-tone to the 4-polyphonic ring-tone, the 8-polyphonic ring-tone, or even the 16-polyphonic ring-tone. Generally, music synthesis highly depends on the computing power of the processor in the electronic device. The electronic device with the stronger computing power can synthesize more polyphony, meaning that more notes can be simultaneously played.

FIG. 1 is a schematic illustration showing a maximum polyphony number of a conventional electronic device. As shown in FIG. 1, it is assumed that the total computing power of the electronic device 10 having a software music synthesizer is X, and the maximum computing power required for only regular operations, which function without the software music synthesizer, is Y. Hence, (X−Y) is the computing power available for running the software music synthesizer. Assuming that M is a constant computing power required to synthesize a tone, the maximum polyphony number would be the maximum integer less than the number of (X−Y)/M. For example, the maximum positive integer is 6, as shown in FIG. 1. As a result, the electronic device 10 has the maximum polyphony number of 6.

The electronic device generally has multiple operation modes, such as an idle mode, a standby mode and an application mode. And, the computing power Y will be different in different mode. However, conventionally, the maximum polyphony number of the electronic device is held constant in any operation mode.

SUMMARY OF THE INVENTION

It is therefore an objective of the invention to provide a method of dynamically determining a maximum polyphony number for each specific operation mode of an electronic device, and further a method of smoothly changing a polyphony number when switching operation modes in order to utilize the computing power of the electronic device adequately and to provide best music synthesis output effect.

The objective of the invention is to provide a method of dynamically determining a maximum polyphony number for each specific operation mode. The method is used in an electronic device having S tone generators, wherein S is a positive integer. First, an operation mode of the electronic device is detected. Next, a residual computing power of the electronic device is obtained according to the operation mode. Then, a maximum polyphony number is determined according to the constant computing power, which is required to synthesize a tone, and the residual computing power under the operation mode. Next, the states of T tone generators of the S tone generators are set to be ON according to the maximum polyphony number, wherein T is a positive integer, being smaller than or equal to S.

The objective of the invention is to provide an electronic device capable of dynamically determining a maximum polyphony number for each specific operation mode. The device includes a system state detecting module, a maximum polyphony number adjusting module and a music synthesizer. The system state detecting module is used for detecting an operation mode of the electronic device. The maximum polyphony number adjusting module obtains a residual computing power of the electronic device according to the operation mode of the electronic device detected by the system state detecting module. The maximum polyphony number adjusting module determines a maximum polyphony number according to the constant computing power, which is required to synthesize a tone, and the residual computing power under the operation mode. The music synthesizer has S tone generators and sets the states of T tone generators of the S tone generators to be ON according to the maximum polyphony number, wherein T is a positive integer, being smaller than or equal to S.

Another objective of the invention is to further provide a method of smoothly changing a polyphony number when switching operation modes. The method is used in an electronic device, which includes S tone generators and has the maximum polyphony numbers of A and B in a first operation mode and a second operation mode respectively. In the method, first, the maximum polyphony number of the electronic device is switched from A to B when the operation mode of the electronic device is switched from the first operation mode to the second operation mode. Then, the number of the ON state tone generators is adjusted from A to B.

Other objects, features, and advantages of the invention will become apparent from the following detailed description of the preferred but non-limiting embodiments. The following description is made with reference to the accompanying drawings.

BRIEF DESCRIPTION OF THE DRAWINGS

FIGS. 6A to 6D are schematic illustrations showing the change of the number of tone generators when the maximum polyphony number of the invention increases.

FIGS. 7A to 7D are schematic illustrations showing the change of the number of tone generators when the maximum polyphony number of the invention decreases.

DETAILED DESCRIPTION OF THE INVENTION

Figure 1:
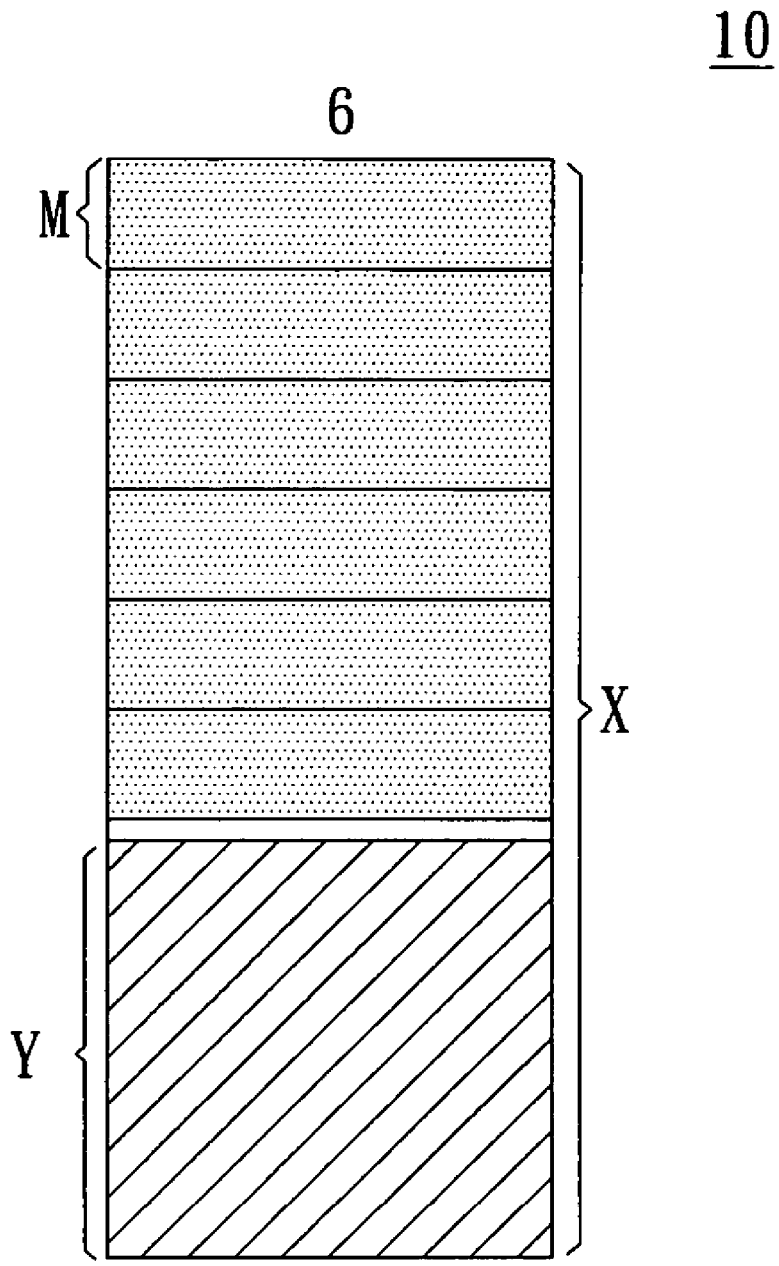
FIG. 1(PRIOR ART)
FIG. 1 is a schematic illustration showing a maximum polyphony number of a conventional electronic device.
Figure 2:
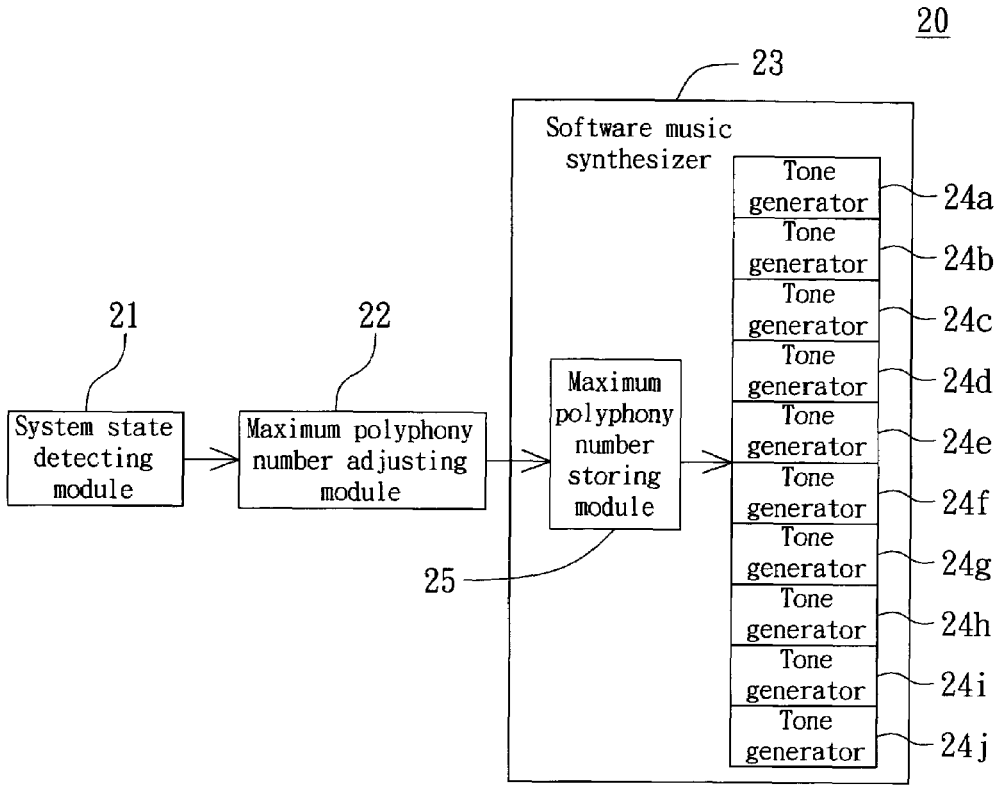
FIG. 2 is a system architecture diagram showing an electronic device capable of dynamically determining a maximum polyphony number for each specific operation mode according to a preferred embodiment of the invention.

FIG. 2 is a system architecture diagram showing an electronic device capable of dynamically determining a maximum polyphony number for each specific operation mode according to a preferred embodiment of the invention. Referring to FIG. 2, the electronic device 20 includes a system state detecting module 21, a maximum polyphony number adjusting module 22 and a software music synthesizer 23. The software music synthesizer 23 includes a maximum polyphony number storing module 25 and S tone generators. In this embodiment, the description will be made by assuming that S is 10 and the software music synthesizer 23 includes tone generators 24*a* to 24*j*.

The system state detecting module 21 is used for detecting an operation mode of the electronic device 20 and then reporting to the maximum polyphony number adjusting module 22. The system state detecting module 21 also detects the executing status of other software modules in the system, which could be a user interface software layer, an application software (game software), and a communication protocol software. According to the executing status of these software modules, the system state detecting module 21 determines the operation mode of the electronic device 20. The maximum polyphony number adjusting module 22 receives the message reposted from the system state detecting module 21, and then computes and transfers a maximum polyphony number to the software music synthesizer 23 accordingly. The software music synthesizer 23 receives the maximum polyphony number and stores it in the maximum polyphony number storing module 25. The software music synthesizer 23 sets the states of T tone generators of the S tone generators 24*a* to 24*j* to be an ON state according to the maximum polyphony number stored in the maximum polyphony number storing module 25, such that the T tone generators in the ON state will synthesize the music to be played by the electronic device 20 in this operation mode, wherein S and T are positive integers and T is smaller than or equal to S.

Figure 3:
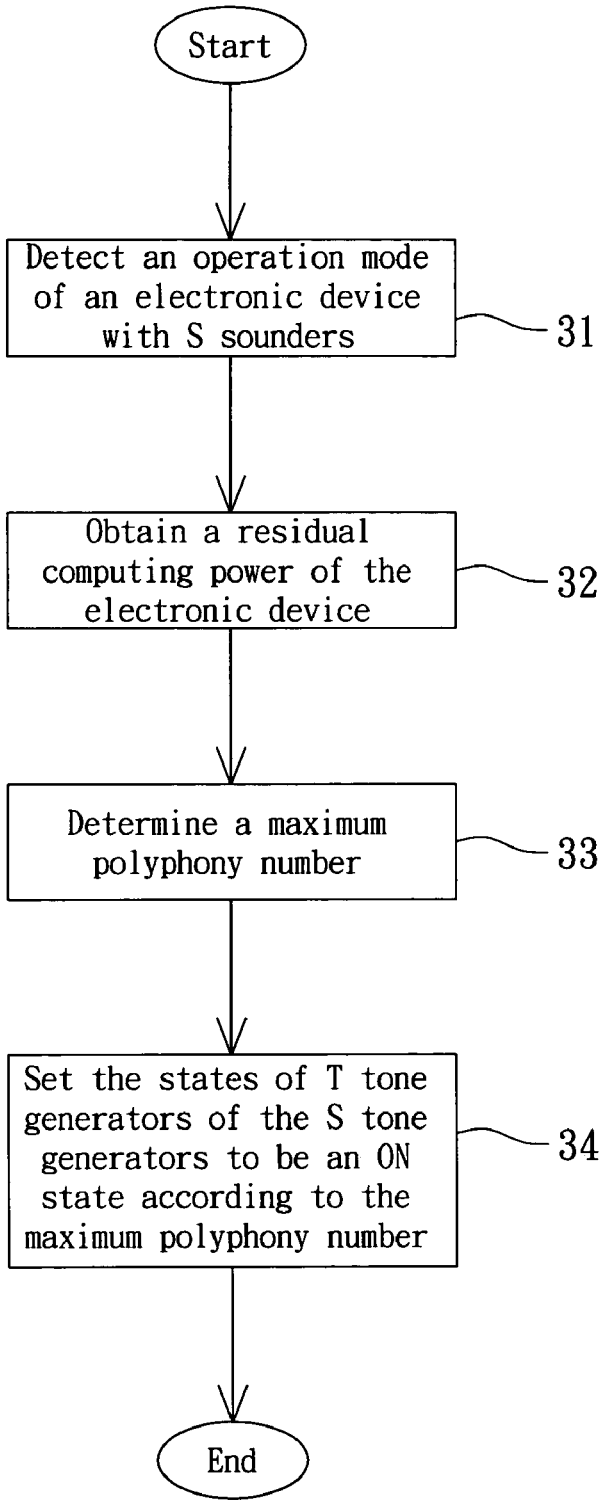
FIG. 3 is a flow chart showing a method of dynamically determining a maximum polyphony number for each specific operation mode according to the preferred embodiment of the invention.

FIG. 3 is a flow chart showing a method of dynamically determining a maximum polyphony number for each specific operation mode according to the preferred embodiment of the invention. The method is used in the electronic device 20 of FIG. 2, and the electronic device 20 has a maximum computing power X. First, in step 31, an operation mode of the electronic device 20 is detected, and a predetermined "computing power required to maintain this operation mode" is obtained according to the operation mode. Next, in step 32, a residual computing power of the electronic device 20 is computed, which is the difference between the maximum computing power (X) and the predetermined computing power required to maintain this operation mode.

Figures 4A, 4B, 4C:
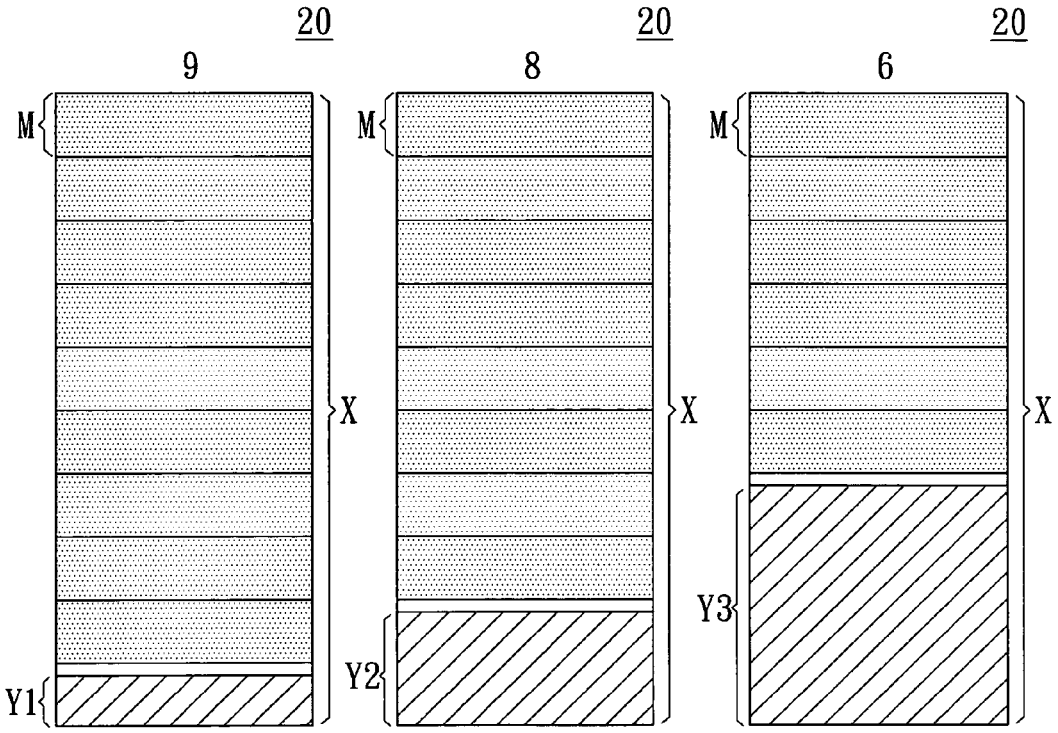
FIG. 4A is a schematic illustration showing that the electronic device of FIG. 2 is dynamically determining the maximum polyphony number in a standby mode.
FIG. 4B is a schematic illustration showing that the electronic device of FIG. 2 is dynamically determining the maximum polyphony number in a communication connecting mode.
FIG. 4C is a schematic illustration showing that the electronic device of FIG. 2 is dynamically determining the maximum polyphony number in an application software executing mode.

In the best embodiment of the invention, the electronic device 20 may be a globe system for mobile communications (GSM) or general packet radio service (GPRS) mobile phone, which utilizes a software music synthesizer to synthesize the music and has at least three kinds of system efficiency states. The first kind is a standby mode, in which the system only maintains the STANDBY state with a base transceiver station. Thus, the required system computing power is low. The second kind is a communication connecting mode, which is also referred to as an on-line mode, in which the system is in a talk state or a data transfer state. So, the required system computing power is higher than the first kind. The third kind is an application software executing mode, which is also referred to as an application mode, in which the system is executing the application software, such as a game state of the mobile phone. So, the required computing power is much higher than the second kind. As shown in FIG. 4A, if the required computing power for the electronic device 20 to maintain a standby mode is Y1, then the residual computing power of the electronic device in the standby mode is (X−Y1). As shown in FIG. 4B, if the required computing power for the electronic device 20 to maintain a communication connecting mode is Y2, then the residual computing power of the electronic device in the communication connecting mode is (X−Y2). As shown in FIG. 4C, if the required computing power for the electronic device 20 to maintain an application software executing mode is Y3, then the residual computing power of the electronic device in the application software executing mode is (X−Y3). The communication connecting mode may be a GSM talk mode, a GPRS data transmission mode or circuit switch data (CSD) transmission mode.

Different communication connecting modes require different system computing powers. Moreover, different states may be classified according to different requirements. Furthermore, in the application software executing mode, the mobile phone games or different application software modules require different computing powers. So, the system can evaluate the software modules built in the mobile phone in advance to obtain the individual best values. With regard to the software that can be downloaded by the user from the network or other passageways, it is a preferred to evaluate in a conservative way in order to maintain the system stability. That is, if possible, it is better to reserve more computing power for the software modules.

Please refer to FIG. 3 again. After the residual computing power of the electronic device 20 is computed, in step 33, a maximum polyphony number is determined according to a constant computing power required to synthesize a tone and the residual computing power. As shown in FIG. 4A, it is assumed that the constant computing power required to synthesize the polyphony is M. In this case, the maximum polyphony number of the electronic device 20 in the standby mode is a maximum positive integer, such as 9, smaller than or equal to (X−Y1)/M. As shown in FIG. 4B, the maximum polyphony number of the electronic device 20 in the communication connecting mode is a maximum positive integer, such as 8, smaller than or equal to (X−Y2)/M. As shown in FIG. 4C, the maximum polyphony number of the electronic device 20 in the application software executing mode is a maximum positive integer, such as 6, smaller than or equal to (X−Y3)/M.

Figure 5:
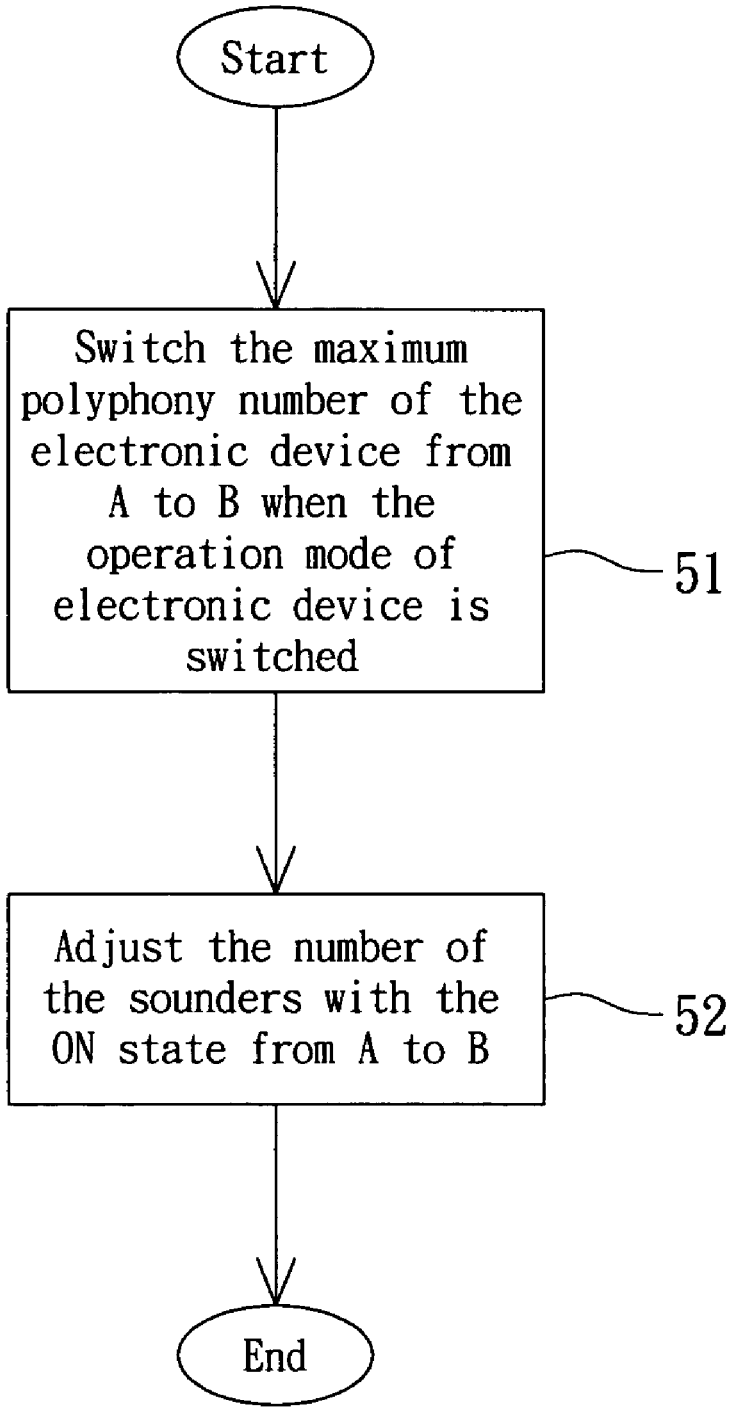
FIG. 5 is a flow chart showing a method of smoothly changing a polyphony number according to the preferred embodiment of the invention.

After the maximum polyphony number of FIG. 3 is determined, in the step 34, the software music synthesizer 23 stores the maximum polyphony number in the maximum polyphony number storing module 25. The software music synthesizer 23 sets the states of T tone generators of the S tone generators to be the ON state, which includes a "STANDBY state" and a "PLAYING state" according to the maximum polyphony number stored in the maximum polyphony number storing module 25, wherein the tone generator in the STANDBY state is prepared for receiving the to-be-played notes and the tone generator in the PLAYING state is playing the received notes. When the tone generator in the "STANDBY state" receives an instruction indicating a note to be played (Note On instruction), the state immediately enters the "PLAYING state". When the tone generator in the "PLAYING state" receives an instruction indicating a note is ended (Note Off instruction), the state immediately enters the "STANDBY state". When the software music synthesizer 23 judges that the maximum polyphony number is smaller than or equal to S, the software music synthesizer 23 sets the states of T tone generators to be ON, wherein T is equal to the maximum polyphony number. The software music synthesizer 23 sets the states of the residual (S−T) tone generators of the S-tone generators to be an OFF state. In addition, when the software music synthesizer 23 judges that the maximum polyphony number is greater than S, since only S tone generators are available in this embodiment, the software music synthesizer 23 sets the states of all the S tone generators to the ON state FIG. 5 is a flow chart showing a method of smoothly changing the polyphony number according to the preferred embodiment of the invention. This method is used in the electronic device 20 of FIG. 2. According to the method of dynamically determining the maximum polyphony number, as shown in FIG. 3, the electronic device 20 has the maximum polyphony numbers of A and B in the first operation mode and the second operation mode, respectively. The electronic device respectively utilizes A and B tone generators of the S tone generators to synthesize a music, wherein A and B are positive integers. As shown in the step 51 of FIG. 5, the maximum polyphony number of the electronic device 20 are firstly switched from A to B when the operation mode of the electronic device 20 are switched from the first operation mode to the second operation mode. Next, in the step 52, the number of tone generators with the ON state is adjusted from A to B, such that B tone generators can be used to synthesize the music when the electronic device 20 is in the second operation mode. The electronic device 20 sets the states of the A tone generators of the S tone generators to be the ON state and sets the states of the residual (S−A) tone generators of the S tone generators to be the OFF state in the first operation mode. When B is smaller than A, the electronic device 20 changes the state of the (A−B) tone generators of the A tone generators from the ON state to the OFF state. When B is greater than A, the electronic device 20 changes the states of the (B−A) tone generators exclusive of the A tone generators of the S tone generators from the OFF state to the ON state.

As shown in FIG. 6A, it is assumed that the maximum polyphony number of the electronic device 20 is 6 while an application software is executing (i.e., A equals 6). Also, as shown in FIG. 6C, the electronic device 20 utilizes the tone generators 24*a*, 24*b*, 24*e*, 24*f*, 24*g* and 24*j* to synthesize a music composition. That is, the tone generators 24*a*, 24*b*, 24*e*, 24*f*, 24*g* and 24*j* are in the ON state. As mentioned above, the ON state may include the STANDBY state and the PLAYING state, and the tone generators 24*a*, 24*b*, 24*e*, 24*f*, 24*g* and 24*j* are dynamically in the STANDBY state (prepared to receive the note) or the PLAYING state (playing the note) due to the varying number of to-be-played notes on the synthesized composition in each specific duration. In FIG. 6A, as the tone generators 24*a*, 24*b*, 24*e*, 24*f*, 24*g* and 24*j* are in the playing states, the states of the tone generators 24*a*, 24*b*, 24*e*, 24*f*, 24*g* and 24*j* are marked as "ON/PLAYING". As the other 4 tone generators 24*c*, 24*d*, 24*h* and 24*i* are in OFF state, the states of the tone generators 24*c*, 24*d*, 24*h* and 24*i* are marked as "OFF."

When the operation mode of the electronic device 20 is switched from the application software executing mode to a communication connecting mode, the maximum polyphony number adjusting module 22 of the electronic device 20 changes the maximum polyphony number from A to B, such as 8. Also, as shown in FIG. 6B, the software music synthesizer 23 of the electronic device 20 receives and stores the maximum polyphony number of 8. Because the electronic device 20 only originally set the states of 6 tone generators 24*a*, 24*b*, 24*e*, 24*f*, 24*g* and 24*j* to be the ON state, the software music synthesizer 23 of the electronic device 20 must additionally change the state of the additional 2 tone generators from the OFF state to the ON state.

As shown in FIG. 6B, due to the increase of the maximum polyphony number after the switch of the operation modes, more tone generators can be turned on. Here, the software music synthesizer 23 changes the states of the tone generators 24*c* and 24*d* from the OFF state to the ON state to adjust the number of the tone generators with the ON state from 6 to 8. The software music synthesizer 23 will change the states of the tone generators 24*c* and 24*d* into the STANDBY state, which is marked as "STANDBY", to prepare to receive the music notes. In other words, when the electronic device 20 switches from one operation mode to another operation mode and has to additionally open one or more tone generators, the software music synthesizer 23 of the electronic device only has to change the states of a specific number of tone generators with the OFF state into the ON state.

As shown in FIG. 6C, when the tone generator 24*c* receives a note-on instruction, its state immediately enters the "PLAYING state" and the tone generator 24*c* plays a note. The state of the tone generator 24*c* is changed from the STANDBY state to the PLAYING state. On the other hand, because the tone generator 24*d* does not receive a note-on instruction, its state is still the STANDBY state. So, in FIG. 6C, the states of the tone generators 24*c* and 24*d* are respectively marked as "ON/PLAYING" and "STANDBY." As shown in FIG. 6D, the tone generators 24*a*~24*g* and 24*j* with the ON state have received a note-on instruction at this time, so the tone generators 24*a*~24*g* and 24*j* are in the PLAYING state and marked as "ON/PLAYING". Of course, the tone generators 24*a*~24*g* and 24*j* with the ON state are dynamically in the STANDBY state (prepare to receive notes) or the PLAYING state (playing the notes) during the whole composition synthesizing process according to the varying number of to-be-played notes on the to-be-synthesized composition in each specific duration. As mentioned above, when the tone generator in the "STANDBY state" receives a note-on instruction, it immediately enters the "PLAYING state". When the tone generator in the "PLAYING state" receives a note-off instruction, it immediately enters the "STANDBY state."

As shown in FIG. 7A, it is assumed that the maximum polyphony number of the electronic device 20 in the communication connecting mode is 8 (i.e., A equals 8). Also, as shown in FIG. 4B, the electronic device 20 utilizes the tone generators 24*a*~24*g* and 24*j* to synthesize a music composition. Thus, the tone generators 24*a*~24*g* and 24*j* are in ON state. At this time, as the tone generators 24*a*~24*g* and 24*j* are playing the notes, they are in the PLAYING states marked as "ON/PLAYING." As the other 2 tone generators 24*h* and 24*i* are in OFF state, the states of tone generators 24*h* and 24*i* are marked as "OFF."

When the operation mode of the electronic device 20 is switched from the communication connecting mode to the application software executing mode, the maximum polyphony number adjusting module 22 of the electronic device 20 changes the maximum polyphony number from A to B, such as 6. Also, as shown in FIG. 4C, the software music synthesizer 23 of the electronic device 20 receives and stores the maximum polyphony number of 6. Because the maximum polyphony number has changed from 8 to 6, the electronic device 20 has to change the states of two tone generator from the tone generators 24*a*~24*g* and 24*j* with the ON state into the OFF state. In other words, the electronic device 20 has to select two tone generators from the tone generators 24*a*~24*g* and 24*j*, and changes their states from the ON state to the OFF state.

Of course, the electronic device 20 also can arbitrarily set two of the tone generators 24*a* to 24*g* and 24*j* to be OFF (i.e., randomly select the tone generators to be switched to the OFF state). This random selection method, however, may cause the note playing procedure to stop and thus deteriorate the whole music composition. As shown in FIG. 7A, the tone generators 24*a*~24*g* and 24*j* are in the PLAYING state or are playing the notes. If the tone generators 24*a* and 24*b* are suddenly changed into the OFF state, the notes might not yet be completely played, and therefore the whole music composition is deteriorated. In order to avoid the above-mentioned condition, another selection method capable of changing the state of the tone generators to OFF without interrupting the note playing procedure will be described in the following.

When the maximum polyphony number has been changed from 8 to 6 and the states of two tone generators with the ON state have to be changed into the OFF state, the software music synthesizer 23 judges whether or not any tone generator with the ON state is in the STANDBY state. If not, the synthesizer 23 waits until one or more than one tone generator with the ON state is in the STANDBY state. In other words, to smoothly turn off the tone generators without affecting the fluency of the music, the synthesizer 23 waits for the tone generators to finish playing before turning off them.

As shown in FIG. 7B, because the tone generator 24*c*, which is originally in the PLAYING state, receives a note-off instruction (the notes have been completed played at this time) and enters the "STANDBY state", the tone generator 24*c* is marked as "STANDBY."

Thus, as shown in FIG. 7C, the software music synthesizer 23 judges that the tone generator 24*c* is in the STANDBY state (the ON state), and changes the state of the tone generator 24*c* from the ON state to the OFF state. At this time, the tone generator 24*d*, which is originally in the PLAYING state, also receives a note-off instruction (the notes have been completed played) and enters the "STANDBY state," so that the tone generator 24*d* is marked as "STANDBY."

Then, as shown in FIG. 7D, the software music synthesizer 23 judges that the tone generator 24*d* is in the STANDBY state (the ON state), and changes the state of the tone generator 24*d* from the ON state to the OFF state, so that the tone generator 24*d* is marked as "OFF."

As show in FIG. 7D, the number of tone generators with the ON state changes from 8 to 6, and the tone generators 24*a*, 24*b*, 24*e*, 24*f*, 24*g* and 24*j* synthesize the music composition. As mentioned above, the tone generators 24*a*, 24*b*, 24*e*, 24*f*, 24*g* and 24*j* are dynamically in the STANDBY state (prepare to receive notes) or the PLAYING state (playing the note) during the overall music composition synthesizing process.

In other words, when the electronic device 20 switches from one operation mode to the other operation mode and a predetermined number (two in the above-mentioned example) of original tone generators with the ON state have to be turned off, the software music synthesizer 23 of the electronic device 20 may change the "STANDBY state" tone generator into the OFF state in a multi-stage manner based on the smoothness of the music. In the above-mentioned example, the software music synthesizer 23 adjusts the polyphony number in two stages. The software music synthesizer 23 firstly changes the state of the tone generator 24*c* from the ON state to the OFF state (first stage, as shown in FIGS. 7B to 7C), and then changes the state of the tone generator 24*d* from the ON state to the OFF state (second stage, as shown in FIGS. 7C to 7D).

Of course, in the above-mentioned example, if the tone generators 24*c* and 24*d* simultaneously enter the "STANDBY state", the software music synthesizer 23 can change the states of the tone generators 24*c* and 24*d* from the ON state to the OFF state simultaneously. In other words, the software music synthesizer 23 does not have to adjust the polyphony number in a multi-stage manner.

In addition, it should be noted that the electronic device 20 may also utilize other selection methods to turn off a predetermined number of original tone generators with the ON state. For example, if all the tone generators with the ON state are in the PLAYING state and the electronic device 20 has to immediately finish the adjustment of the polyphony number (i.e., the electronic device 20 would not wait the tone generator to switch from the PLAYING state to the STANDBY state), then the software music synthesizer 23 can select a predetermined number of original tone generators with the ON state to change the state of the tone generators with the ON state into the OFF state according to the volume of the voice outputted from the "PLAYING state" tone generator. The software music synthesizer 23 firstly selects the tone generator with smaller volume to change the state of the tone generator from the ON state to the OFF state for smoothness of the music.

In addition, the software music synthesizer 23 also can select a predetermined number of original tone generators with the ON state to change the states of the tone generators with the ON state to the OFF state according to the frequency of the output voice of the "PLAYING state" tone generator. Similarly, the software music synthesizer 23 firstly selects the tone generator with lower voice frequency to the OFF state.

The method of dynamically determining the maximum polyphony number according to the embodiment of the invention provides the optimized dynamic polyphony adjusting technology with respect to the software music synthesizer, which dynamically adjusts the maximum polyphony number of the electronic device and simultaneously maintains itself in a normal operation condition according to different electronic device operation modes. The invention further smoothly changes the polyphony number according to the switching method of the operation mode of the electronic device, so that the system computing power can be optimized and the best composition output effect can be provided.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation to encompass all such modifications and similar arrangements and procedures.

What is claimed is:

1. A method of dynamically determining a maximum polyphony number, the method being used in an electronic device having S tone generators, wherein S is a positive integer, the method comprising:

detecting an operation mode of the electronic device;

obtaining a residual computing power of the electronic device according to the operation mode of the electronic device;

determining a maximum polyphony number according to a constant computing power required to synthesize a polyphony and the residual computing power; and setting the states of T tone generators of the S tone generators to be an ON state according to the maximum polyphony number, wherein T is a positive integer and is smaller than or equal to S.

2. The method according to claim 1, wherein the operation mode of the electronic device is selected from any one of the group consisting of a standby mode, a communication connecting mode and an application software executing mode.

3. The method according to claim 1, wherein the step of setting the states of the T tone generators of the S tone generators to be the ON state comprises:

setting the states of the T tone generators of the S tone generators to be the ON state when the maximum polyphony number is smaller than or equal to S, wherein T equals the maximum polyphony number.

4. The method according to claim 3, wherein the states of the residual (S−T) tone generators of the S tone generators are set to be an OFF state.

5. The method according to claim 1, wherein the step of setting the states of the T tone generators of the S tone generators to be the ON state comprises:

setting the states of the S tone generators to be the ON state when the maximum polyphony number is greater than S, wherein T is equal to S.

6. The method according to claim 1, wherein the ON state comprises a STANDBY state and a PLAYING state.

7. The method according to claim 1, wherein the electronic device has a maximum computing power of X, and the step of obtaining the residual computing power comprises:

detecting the operation mode of the electronic device to obtain a computing power of Y, which is required for the electronic device to maintain the operation mode; and obtaining the residual computing power of (X−Y) according to the maximum computing power and the computing power.

8. The method according to claim 7, wherein the constant computing power is M, and the step of determining the maximum polyphony number comprises:

determining that the maximum polyphony number is a maximum positive integer which is smaller than or equal to (X−Y)/M according to the constant computing power and the residual computing power.

9. An electronic device capable of dynamically determining a maximum polyphony number, the electronic device comprising:

a system state detecting module for detecting an operation mode of the electronic device;

a maximum polyphony number adjusting module for obtaining a residual computing power of the electronic device according to the operation mode of the electronic device detected by the system state detecting module, and for determining the maximum polyphony number according to a constant computing power, which is required to synthesize a polyphony, and the residual computing power; and a music synthesizer, which has S tone generators and sets the states of T tone generators of the S tone generators to be an ON state according to the maximum polyphony number, wherein T is a positive integer and is smaller than or equal to S.

10. The electronic device according to claim 9, wherein the operation mode of the electronic device is selected from any one of the group consisting of a standby mode, a communication connecting mode and an application software executing mode.

11. The electronic device according to claim 9, wherein when the music synthesizer judges that the maximum polyphony number is smaller than or equal to S, the music synthesizer sets the states of the T tone generators to be the ON state, and T equals the maximum polyphony number.

12. The electronic device according to claim 11, wherein the music synthesizer sets the (S−T) tone generators of the S tone generators to be an OFF state.

13. The electronic device according to claim 9, wherein when the music synthesizer judges that the maximum polyphony number is greater than S, the music synthesizer sets the states of the S tone generators to be the ON state.

14. The electronic device according to claim 9, wherein the ON state comprises a STANDBY state and a PLAYING state.

15. The electronic device according to claim 9, wherein when the maximum computing power of the electronic device is X and the constant computing power is M, the maximum polyphony number adjusting module obtains a computing power of Y, which is required for the electronic device to maintain the operation mode according to the operation mode of the electronic device, obtains the residual computing power of (X−Y) according to the maximum computing power and the computing power, and determines that the maximum polyphony number is a maximum positive integer which is smaller than or equal to (X−Y)/M according to the constant computing power and the residual computing power.

16. The electronic device according to claim 9, wherein the music synthesizer has a maximum polyphony number storing module for storing the maximum polyphony number.

17. A method of dynamically adjusting a polyphony number being used in an electronic device, including S tone generators and having the maximum polyphony numbers of A and B in a first operation mode and a second operation mode respectively, wherein the electronic device sets the A and B tone generators of the S tone generators to be an ON state, and S, A and B are positive integers, the method comprising:

switching the maximum polyphony number of the electronic device from A to B when the operation mode of the electronic device is switched from the first operation mode to the second operation mode; and adjusting the number of the tone generators with the ON state from A to B.

18. The method according to claim 17, wherein the electronic device sets the A tone generators of the S tone generators to be the ON state and sets the states of the residual (S−A) tone generators of the S tone generators to be an OFF state in the first operation mode, and the step of adjusting the number of the tone generators with the ON state from A to B comprises:

switching the states of the (B−A) tone generators exclusive of the A tone generators of the S tone generators from the OFF state to the ON state when B is greater than A.

19. The method according to claim 18, wherein the ON state comprises a PLAYING state and a STANDBY state, and the states of the (B−A) tone generators exclusive of the A tone generators of the S tone generators are switched from the OFF state to the STANDBY state of the ON state.

20. The method according to claim 17, wherein the electronic device sets the A tone generators of the S tone generators to be the ON state in the first operation mode, and the step of adjusting the number of the tone generators with the ON state from A to B comprises:

switching the states of the (A−B) tone generators of the A tone generators from the ON state to the OFF state when B is smaller than A.

21. The method according to claim 20, wherein the ON state comprises a PLAYING state and a STANDBY state, and the step of switching the states of the (A−B) tone generators of the A tone generators from the ON state to the OFF state comprises:

waiting for a period of time when the state of at least one tone generator of the (A−B) tone generators being switched from the PLAYING state to the STANDBY state;

switching the state of the at least one tone generator of the (A−B) tone generators from the STANDBY state to the OFF state; and repeating the above-mentioned steps until the (A−B) tone generators are switched to the OFF state.

22. The method according to claim 20, wherein the step of switching the states of the (A−B) tone generators of the A tone generators from the ON state to the OFF state comprises:

selecting the (A−B) tone generators with smaller volumes according to the volumes of the voices outputted from the A tone generators to switch the states of the (A−B) tone generators from the ON state to the OFF state.

23. The method according to claim 20, wherein the step of switching the states of the (A−B) tone generators of the A tone generators from the ON state to the OFF state comprises:

selecting the (A−B) tone generators with lower frequencies according to the frequencies of the voices outputted from the A tone generators to switch the states of the (A−B) tone generators from the ON state to the OFF state.

24. The method according to claim 20, wherein the step of switching the states of the (A−B) tone generators of the A tone generators from the ON state to the OFF state comprises:

randomly selecting the (A−B) tone generators from the A tone generators to switch the states of the (A−B) tone generators from the ON state to the OFF state.

25. The method according to claim 17, wherein the maximum polyphony numbers of A and B in the first operation mode and the second operation mode are respectively determined by a determining step, which comprises:

detecting the first operation mode and the second operation mode of the electrical device;

obtaining a first residual computing power and a second residual computing power of the electronic device according to the first operation mode and the second operation mode, respectively;

determining the maximum polyphony number of the electronic device in the first operation mode to be A according to a constant computing power, which is required to synthesize a polyphony, and the first residual computing power; and determining the maximum polyphony number of the electronic device in the second operation mode to be B according to the constant computing power and the second residual computing power.

26. The method according to claim 25, further comprising:

setting the states of the A tone generators of the S tone generators to be the ON state when A is smaller than S.

27. The method according to claim 25, further comprising:

setting the states of the S tone generators to be the ON when A is equal to or greater than S.

28. The method according to claim 25, wherein the electronic device has a maximum computing power of X, and the step of obtaining the first residual computing power comprises:

detecting the first operation mode of the electronic device to obtain a computing power of Y, which is required for the electronic device to maintain the first operation mode; and obtaining the first residual computing power of (X−Y) according to the maximum computing power and the computing power.

29. The method according to claim 28, wherein the constant computing power is M, the step of determining the maximum polyphony number of the electronic device to be A in the second operation mode further comprises:

determining A to be a maximum positive integer which is smaller than or equal to (X−Y)/M according to the constant computing power and the first residual computing power.

30. The method according to claim 17, wherein the first operation mode and the second operation mode are selected from any two of the group consisting of a standby mode, a communication connecting mode and an application software executing mode.

31. The method according to claim 30, wherein the communication connecting mode is a GSM talk mode, a GPRS data transmission mode, or a circuit switch data (CSD) transmission mode.

32. The method according to claim 17, wherein one of the first operation mode and the second operation mode is a communication connecting mode.

33. The method according to claim 31, wherein the communication connecting mode is a GSM talk mode, a GPRS data transmission mode, or a circuit switch data (CSD) transmission mode.

34. The method according to claim 17, wherein one of the first operation mode and the second operation mode is an application software executing mode.

35. The method according to claim 17, wherein one of the first operation mode and the second operation mode is a standby mode.

* * * * *